US005483985A

United States Patent [19]

Yu

[11] Patent Number: 5,483,985

[45] Date of Patent: Jan. 16, 1996

[54] FULLY AUTOMATIC AND SIMPLIFIED CONTROL STRUCTURE

[76] Inventor: Shu-Chun Yu, 425, Chung Shin Road, Pin Chang City, Taoyuan Shien, Taiwan

[21] Appl. No.: 340,908

[22] Filed: Nov. 15, 1994

[51] Int. Cl.[6] ..... A45B 25/14

[52] U.S. Cl. ..... 135/22; 135/24

[58] Field of Search ..... 135/22, 24, 23, 135/25.1, 25.4, 25.41, 37, 38, 39, 40

[56] References Cited

U.S. PATENT DOCUMENTS

| | | | |
|---|---|---|---|
| 3,658,077 | 4/1972 | Sato | 135/22 |
| 5,144,969 | 9/1992 | Chou et al. | 135/22 |
| 5,224,505 | 7/1993 | Wu | 135/24 |
| 5,232,004 | 8/1993 | Wu | 135/24 |

*Primary Examiner*—Lanna Mai

*Attorney, Agent, or Firm*—Morton J. Rosenberg; David I. Klein

[57] ABSTRACT

An umbrella control structure for automatic opening and closing is provided. A leaf spring maintains an umbrella closing spring in a compressed state when a control tab is moved upwardly to cause opening of the umbrella. The upward movement of the control tab causes a control tube to be displaced upwardly to release an active strut guide which permits an umbrella unfolding coil spring to cause the umbrella frame members to open outwardly. Subsequent downward displacement of the control tab causes a movable tab to displace the leaf spring. Displacement of the leaf spring releases a slidable inner tube member which releases the umbrella closing spring to cause the umbrella frame members to move inwardly and thereby close the umbrella.

1 Claim, 12 Drawing Sheets

FULLY AUTOMATIC AND SIMPLIFIED CONTROL STRUCTURE

BACKGROUND OF THE INVENTION

Contemporary umbrella designs already feature the development of automatic umbrella structures utilizing simple operation that enables the umbrella to quickly and automatically unfold into the open position and automatically fold into the closed state. There are many types of similarly manufactured designs which are capable of yielding such operational results.

Although the aforementioned type of umbrella achieves the objective of automatic unfolding and folding, the manufacturing involved is extremely complicated, especially the sections of the lower cross-sectional structural framework. That structure not only entails difficult assembly, but also results in steep production costs and manufacturing inconvenience. Further, the finished products are highly susceptible to operational malfunctions and adjustment difficulties, leading ultimately to hindrances in utilization.

In view of the foregoing situation, the primary objective of the invention herein is to provide a kind of improved control structure that is completely automatic and simplified which precludes the aforementioned shortcomings based on a less complex control structure capable of fully automatic unfolding and folding performance.

The relevant drawings and detailed description relating to the structure and functions of the invention herein are attached below.

DETAILED DESCRIPTION OF THE PREFERRED EMBODIMENT

As alluded to in the foregoing section, the structural basis and main innovation of the invention herein consists of an improvement to the latching structure.

Figure 1:
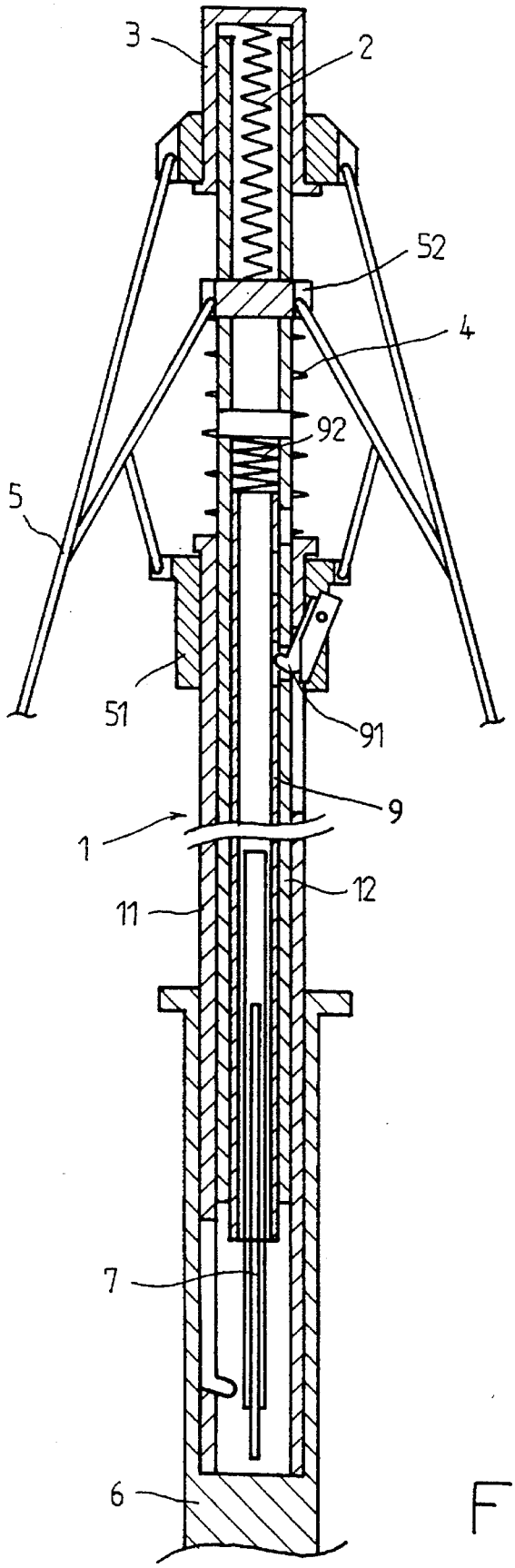
FIG. 1 is a cross-sectional drawing of the present invention when folded.
Figure 2:
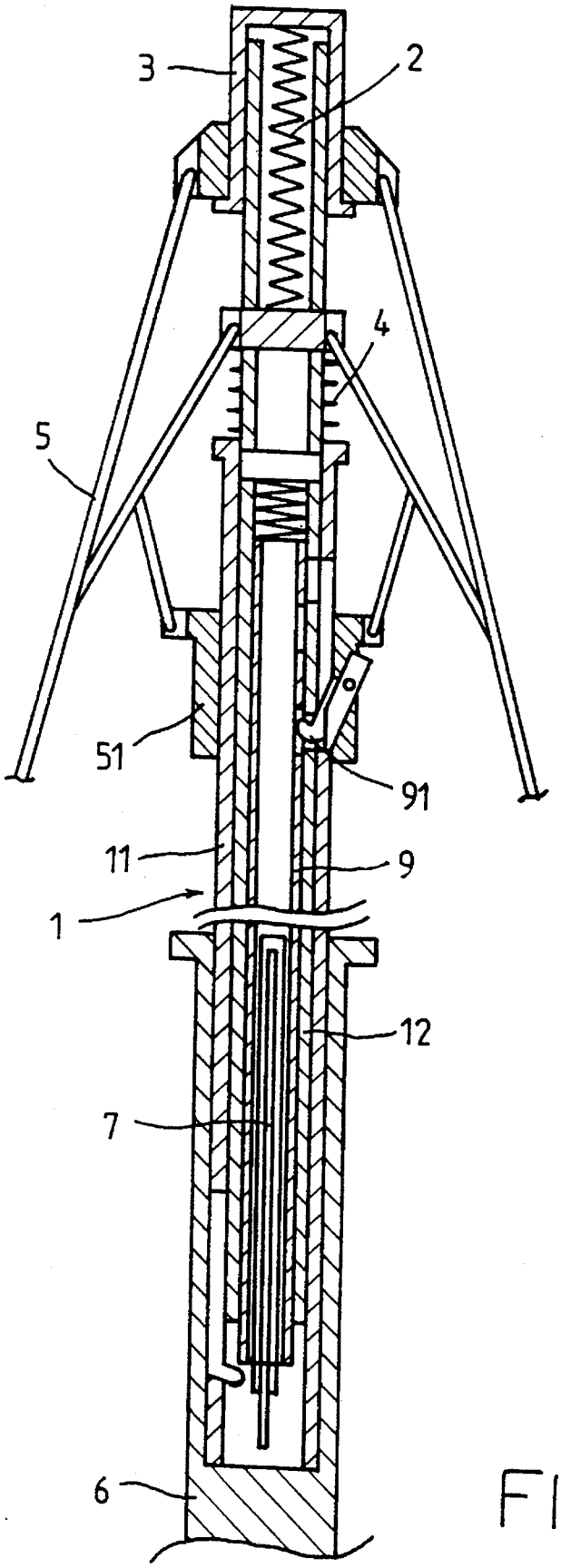
FIG. 2 is a cross-sectional drawing of the present invention when retracted for storage.
Figure 3:
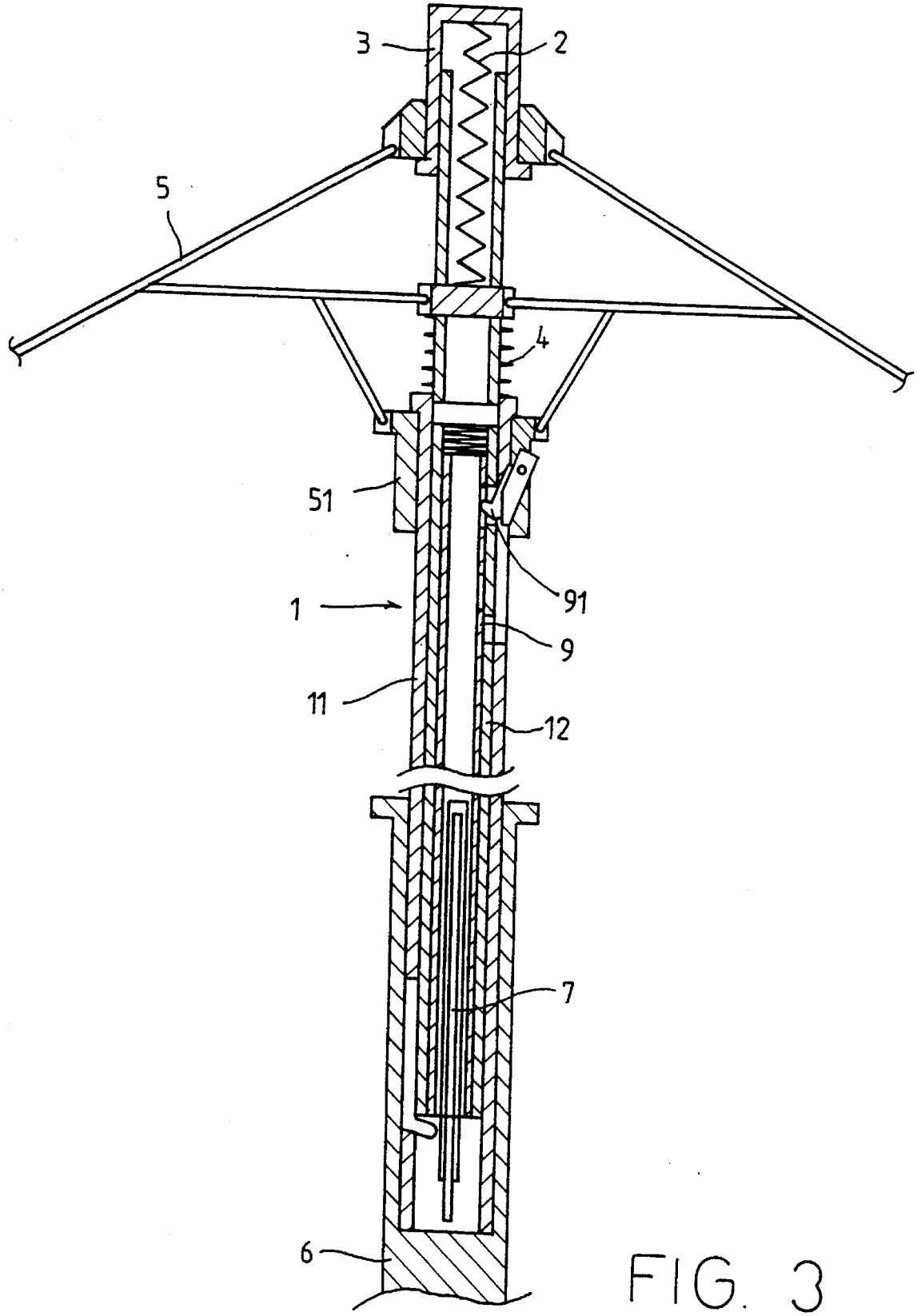
FIG. 3 is a cross-sectional drawing of the present invention when unfolded.
Figure 4:
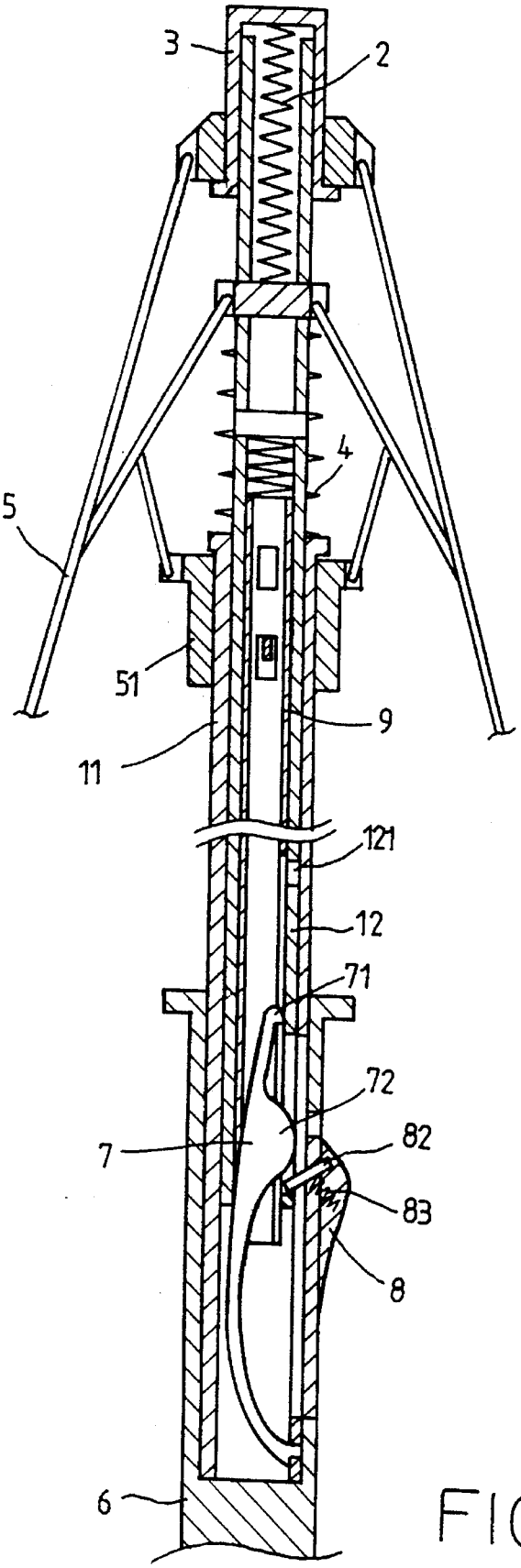
FIG. 4 is a cross-sectional drawing of the present invention, with the plane of depiction rotated 90 degrees clockwise relative to the representation in FIG. 1.
Figure 5:
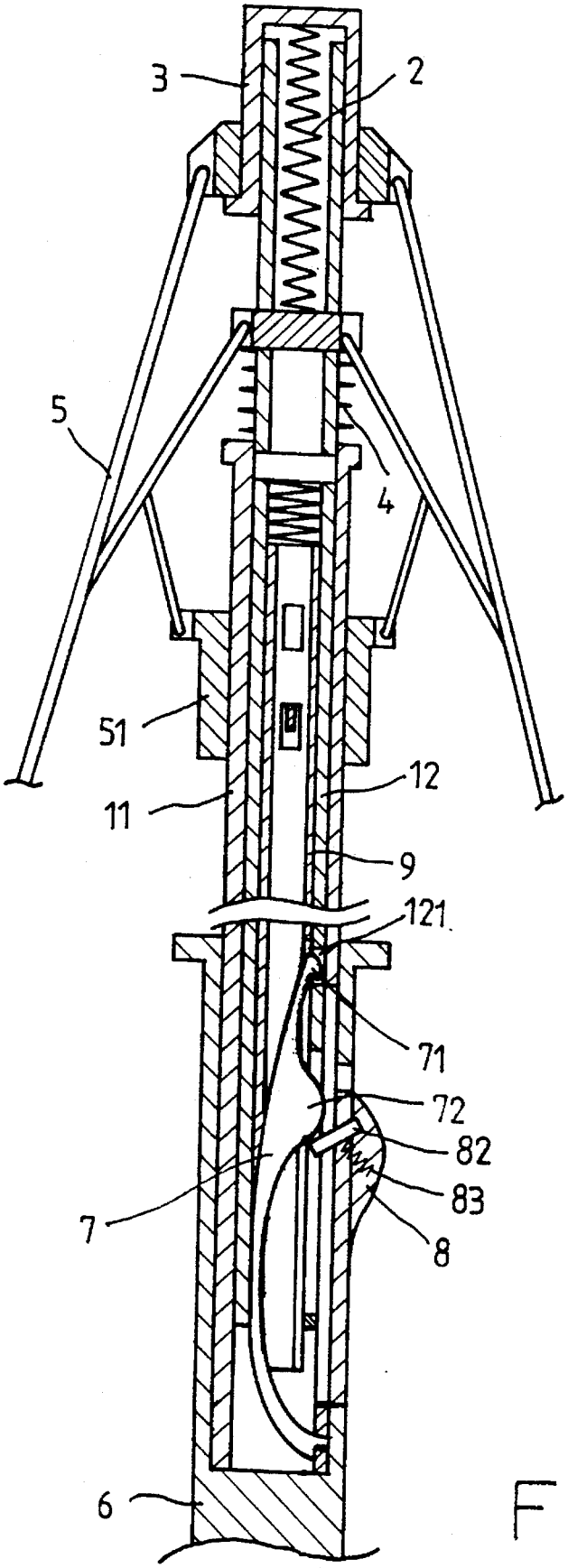
FIG. 5 is a cross-sectional drawing of the present invention, with the plane of depiction rotated 90 degrees clockwise relative to the representation in FIG. 2.
Figure 7:
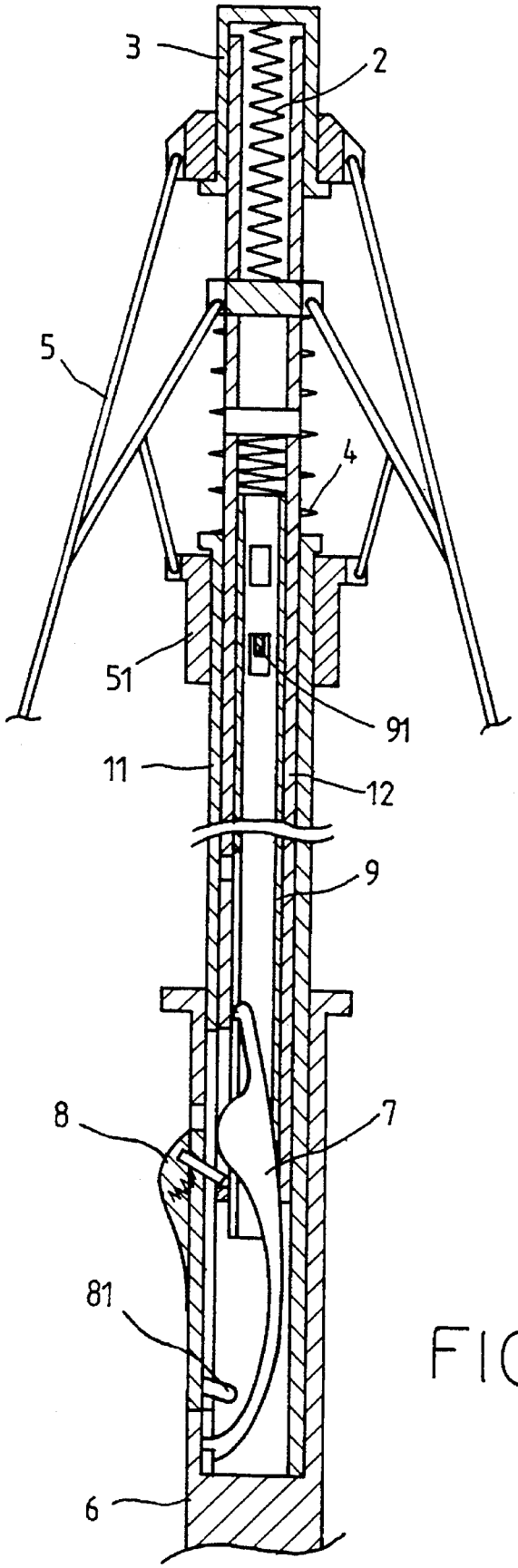
FIG. 7 is a cross-sectional drawing of the present invention, with the plane of depiction rotated 90 degrees counterclockwise relative to the representation in FIG. 1.
Figure 8:
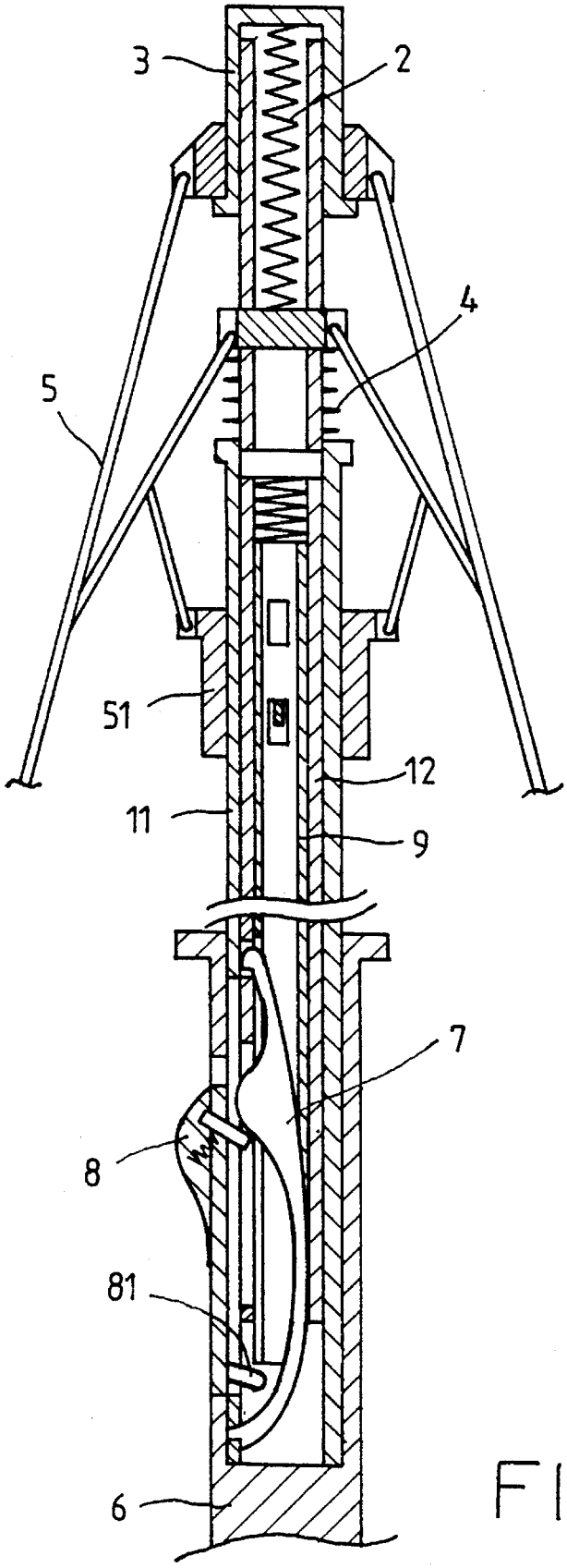
FIG. 8 is a cross-sectional drawing of the present invention, with the plane of depiction rotated 90 degrees counterclockwise relative to the representation in FIG. 2.

Referring to FIGS. 1, 4 and 7, the invention herein is primarily comprised of a leaf spring 7 positioned inside the lower end of the inner tube 12 and a control tab 8 assembled into an opening formed in the lower end of the outer tube 11 and an opening in handle 6 to be slidably displaceable therein. Following the compression of the coil spring 4 responsive to displacement of the inner tube 12 into the outer tube 11, during umbrella closure, the hook section 71 on the upper extent of the leaf spring 7 is engaged into the positioner hole 121 at the lower end of the inner tube 12, as indicated in FIGS. 2, 5 and 8.

Figure 6:
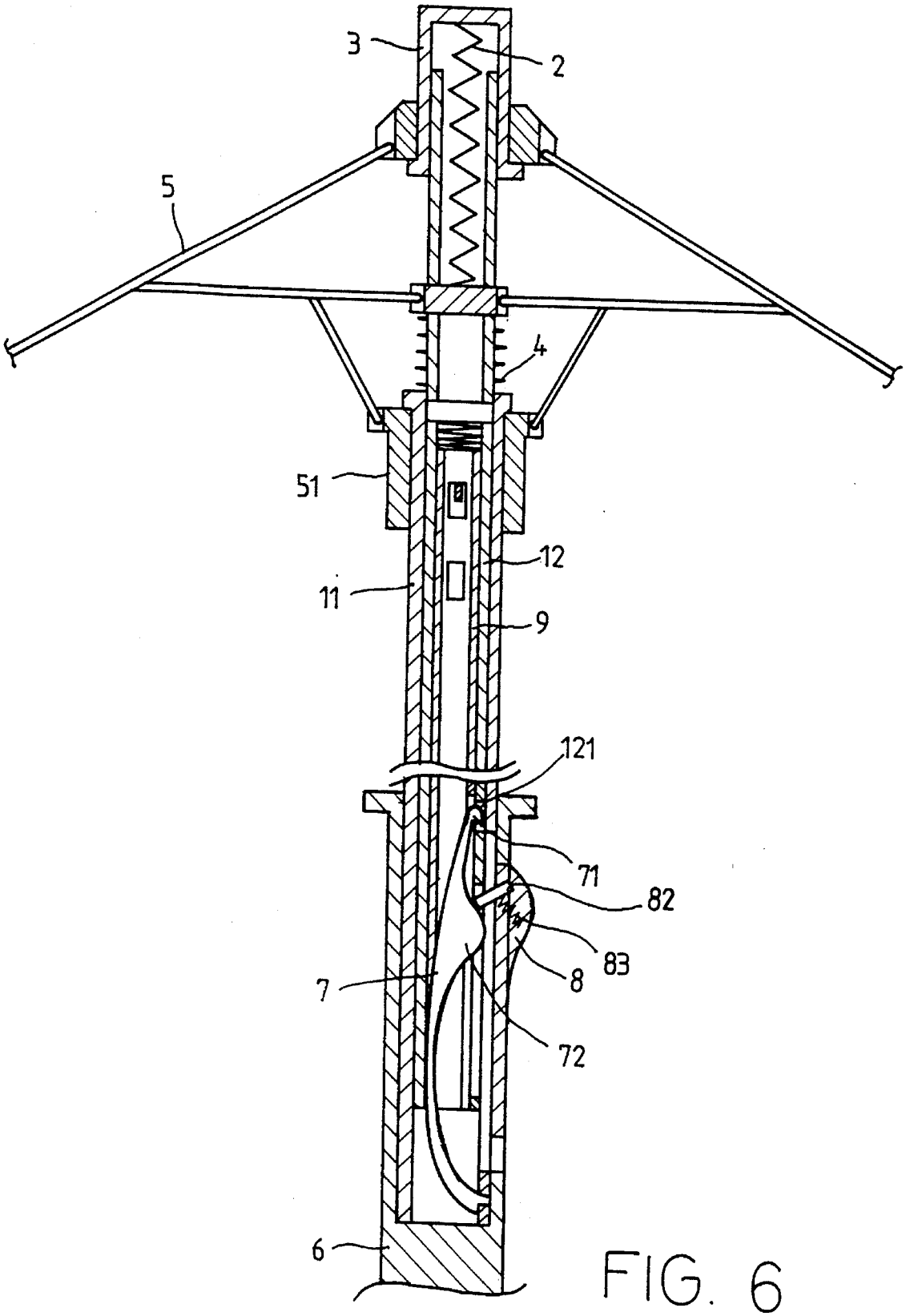
FIG. 6 is a cross-sectional drawing of the present inventions, with the plane of depiction rotated 90 degrees clockwise relative to the representation in FIG. 3.
Figure 9:
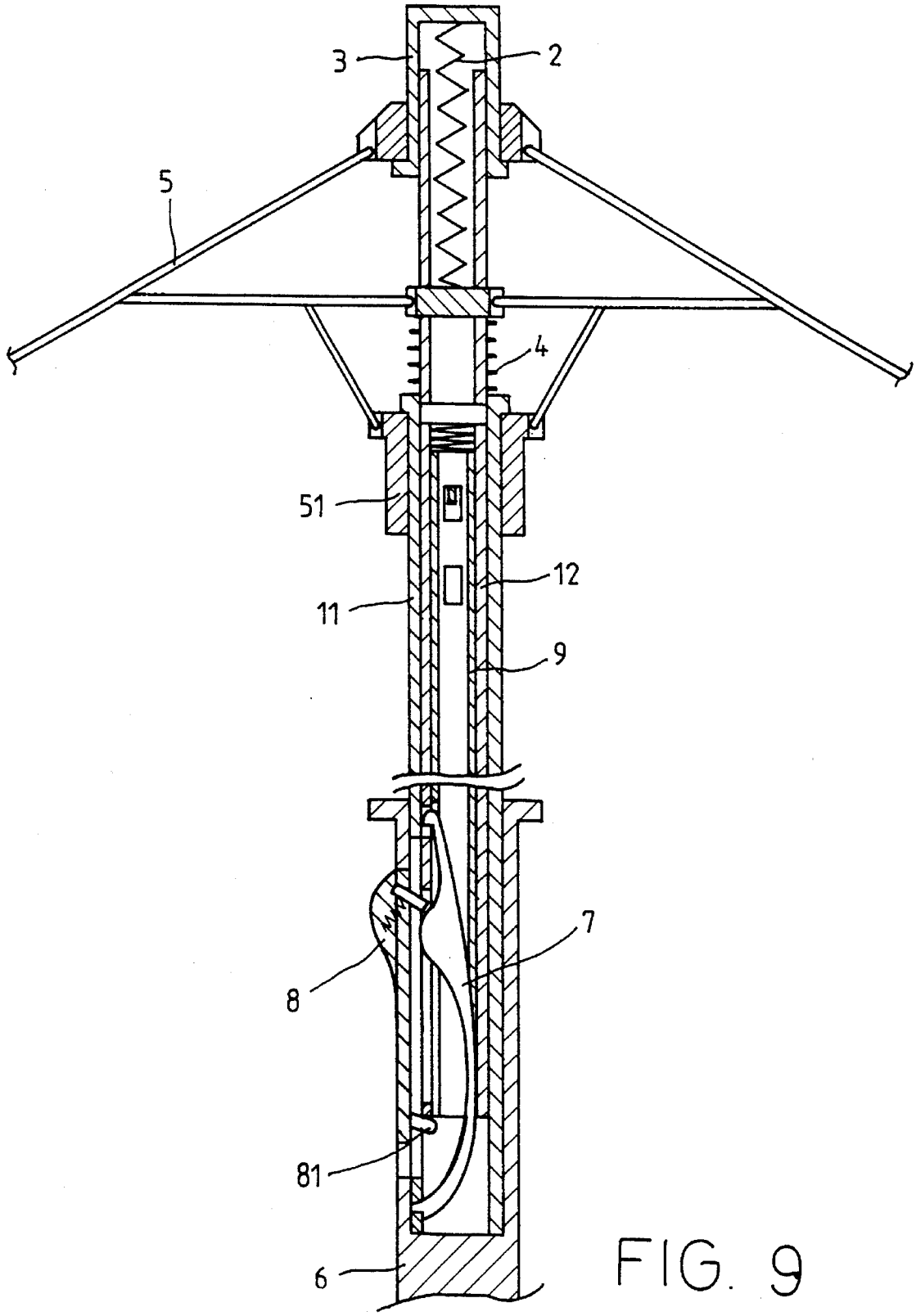
FIG. 9 is a cross-sectional drawing of the present invention, with the plane of depiction roated 90 degrees counterclockwise relative to the representation in FIG. 3.
Figure 10:
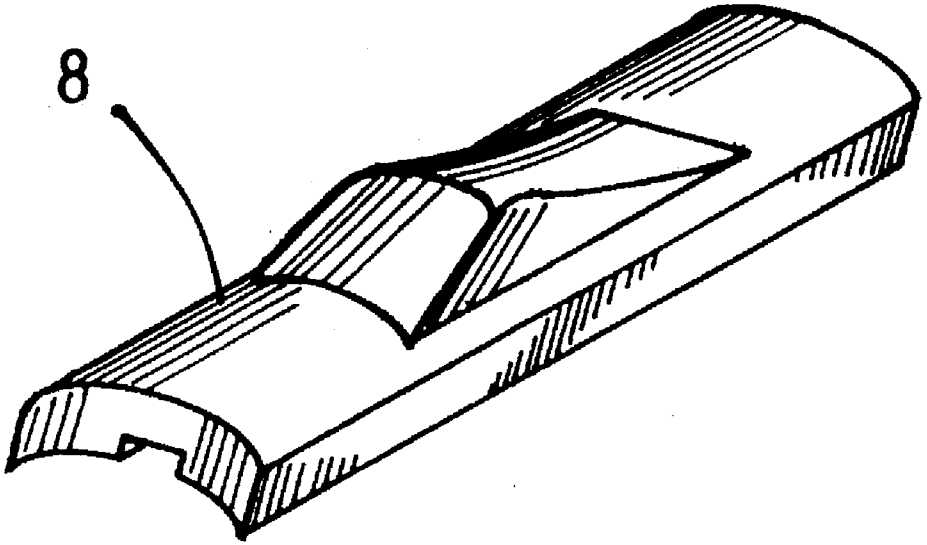
FIG. 10 is a perspective view of the control tab of the present invention.
Figure 11:
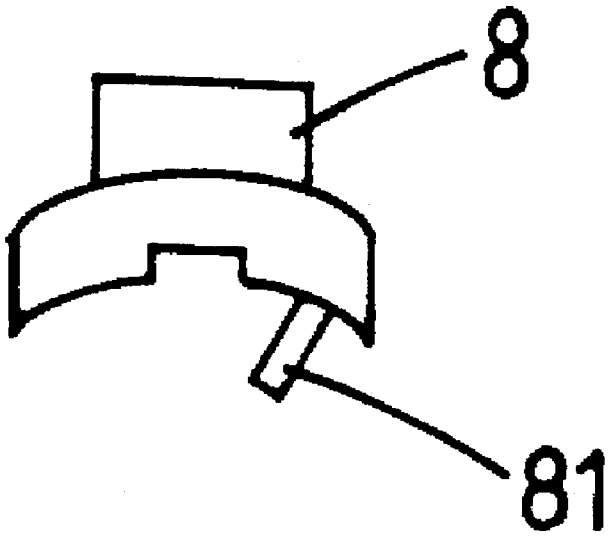
FIG. 11 is an end view of the control tab of FIG. 10.

Referring to FIGS. 8, 9, 11 and 12, it can be seen that when the umbrella is to be unfolded, it is only necessary that the control tab 8 be moved upward, an action that results in a rising movement of the knock pin 81 which extends from the interior side of the control tab 8. The knock pin 81 pushes the sliding control tube 9 inside, which is disposed within the inner tube 12, upwards against the bias of a spring 92, eventually pushing against and thereby actuating the interlock unit 91 to release engagement from a first opening in the upper end of control tube 9, allowing the active strut guide 51 to move upward, with the interlock unit then engaging a second opening in control tube 9, as shown in FIG. 9. With the release of the active strut guide 51, the unfolding coil spring 2, under increasing tensile pressure, causes the umbrella frame members 5 to opens outwards, as indicated in FIGS. 5, 6 and 9. The unfolding coil spring 2 is disposed between the sliding strut guide 52 and the closed end of a cap 3 which is slidably coupled to the upper end of the inner tube 12.

Figure 12:
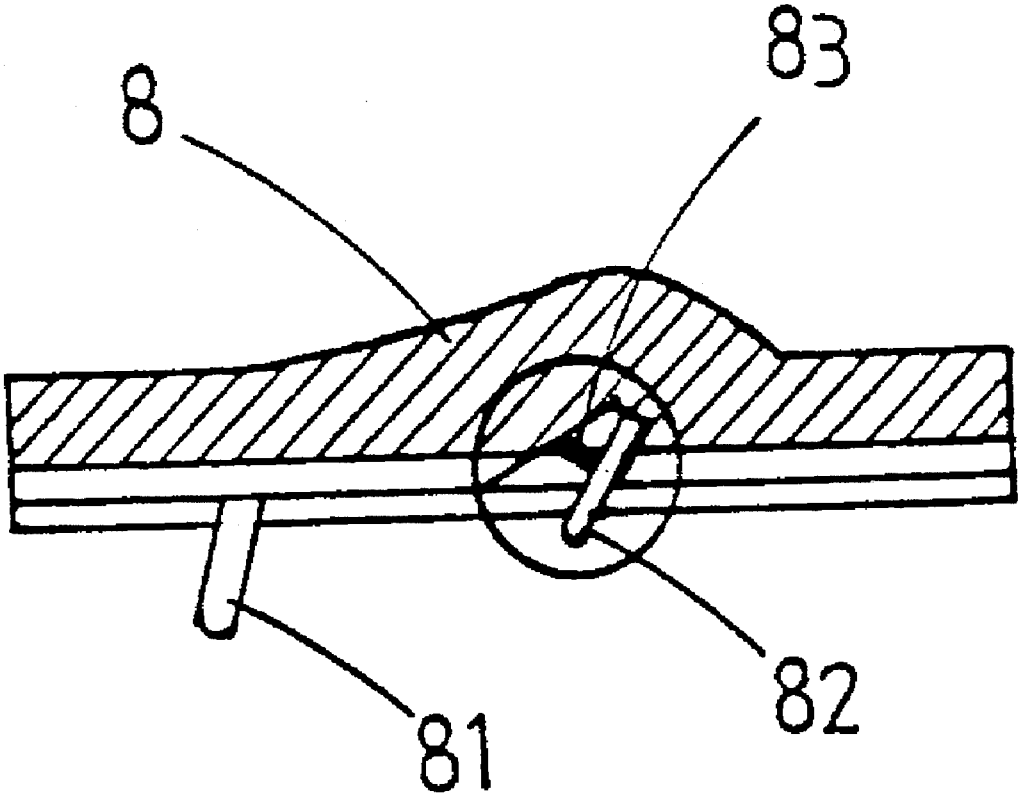
FIG 12 is a crossesectional side view of the control tab of FIG. 10.

When the aforesaid control tab 8 is moved upward, another movable tab 82 extending from the interior side of the control tab 8 and displaceably coupled thereto is prevented from displacing the convex section 72 of the leaf spring 7 as it passes thereby. As best shown in FIG. 12, there is a small spring 83 biasing tab 82 and allowing it to be displaced as the control tab 8 is moved upward. Therefore, the presence of inward pressure on the spring as the control tab 10 is moved upwardly circumvents the movable tab 82 from displacing the leaf spring 7. However, when the control tab 8 is moved downward, the movable tab 82 cannot be displaced as it makes contact against the convex section 72 of the leaf spring 7 and gradually presses the leaf spring 7 into movement. Displacement of leaf spring 7 causes the hook section 71 of the leaf, at the upper extent of the leaf spring 7, to disengage from the inner tube 12. Responsive to release from the hook section 71, the inner tube 12 under the force of the umbrella folding coil spring 4 is driven into graduated upward movement and the spring 92 downwardly displaces the control tube 9, resulting in the umbrella returning to the folding state, as indicated in FIGS. 1, 4 and 7.

In summation of the foregoing description, the disclosed umbrella structure only utilizes a single leaf spring in cooperation with movable tubes, which results in the attainment of fully automatic umbrella unfolding and folding performance, with the simplicity of the manufacturing aspects clearly illustrated by the originality achieved by the assembly design.

What is claimed is:

1. An umbrella control structure for automatically opening and closing an umbrella framework, comprising:

a longitudinally extended outer tube having opposing first and second ends, said outer tube having a first longitudinally directed slotted opening formed therethrough adjacent said first end and a second longitudinally directed slotted opening formed therethrough adjacent said second end thereof;

a handle coupled to said first end of said outer tube, said handle having a third longitudinally directed slotted opening formed therethrough and disposed in aligned relationship with said first slotted opening;

a longitudinally extended inner tube having a first end slidably disposed within said outer tube and a positioner hole disposed adjacent thereto, said inner tube having a pair of longitudinally spaced apertures disposed intermediate said first end thereof and a second end of said inner tube, said pair of apertures being in aligned relation ship with said second slotted opening;

a closing coil spring positioned concentrically on said inner tube and having one end disposed adjacent said second end of said outer tube and an opposing end disposed adjacent a lower surface of a sliding guide of the umbrella framework;

a tubular cap slidably coupled to said second end of said inner tube and having a closed upper end;

an opening coil spring positioned within said second end of said inner tube and having one end disposed adjacent said closed upper end of said tubular cap and an opposing end disposed adjacent an upper surface of the sliding guide of the umbrella framework;

means for interlocking an active strut guide of said umbrella framework slidably disposed on said outer tube to either of two positions on said outer tube, said interlock means including means for engaging either of said pair of apertures of said inner tube through said second slotted opening of said outer tube;

a longitudinally extended control tube slidably disposed within said inner tube, said control tube having an upper end adapted to displace said engaging means to permit displacement of the active strut guide;

a leaf spring disposed within said first end of said outer tube and having a first end coupled thereto, said leaf spring having a longitudinally displaced hook-shape second end to engagement with said poisitioner hole of said inner tube, said leaf spring having a camming surface disposed intermediate said first and second end thereof; and, a control tab disposed within said first and third slotted openings for slidable coupling to said outer tube and said handle, said control tab having a knock pin extending therefrom for contacting and upwardly displacing said control tube responsive to an upward displacement of said control tab to displace said engaging means and open the umbrella framework by a force from said opening coil spring, said control tab having a spring biased movable tab extending therefrom in sliding contact with said camming surface of said leaf spring, said movable tab being displaced by said camming surface responsive to said upward displacement of said control tab and displacing said camming surface responsive to a subsequent downward displacement of said control tab, said leaf spring second end being disengaged from said positioner hole responsive to displacement of said camming surface of said leaf spring to close the umbrella framework by a force from said closing coil spring.

* * * * *